US011744418B2

(12) United States Patent
Romero

(10) Patent No.: US 11,744,418 B2
(45) Date of Patent: Sep. 5, 2023

(54) WET/DRY VACUUM DEVICE

(71) Applicant: Norco Industries, Inc., Compton, CA (US)

(72) Inventor: Jeff Romero, Middlebury, IN (US)

(73) Assignee: Norco Industries, Inc., Compton, CA (US)

( * ) Notice: Subject to any disclaimer, the term of this patent is extended or adjusted under 35 U.S.C. 154(b) by 94 days.

(21) Appl. No.: 17/543,601

(22) Filed: Dec. 6, 2021

(65) Prior Publication Data

US 2022/0087488 A1 Mar. 24, 2022

Related U.S. Application Data

(63) Continuation of application No. 16/425,041, filed on May 29, 2019, now Pat. No. 11,202,540.

(51) Int. Cl.

| | |
|---|---|
| ***A47L 7/00*** | (2006.01) |
| ***A47L 5/16*** | (2006.01) |
| ***A47L 9/32*** | (2006.01) |

(52) U.S. Cl.

CPC ..... *A47L 7/0014* (2013.01); *A47L 5/16* (2013.01); *A47L 7/0019* (2013.01); *A47L 9/322* (2013.01)

(58) Field of Classification Search

CPC . A47L 5/16; A47L 5/28; A47L 7/0014; A47L 7/0019; A47L 7/0028; A47L 7/0038; A47L 9/0072; A47L 9/0081; A47L 9/322

See application file for complete search history.

(56) References Cited

U.S. PATENT DOCUMENTS

| | | | | |
|---|---|---|---|---|
| 3,971,096 | A * | 7/1976 | Renholt | A47L 5/18 15/409 |
| 4,845,802 | A * | 7/1989 | Miller | A47L 11/34 15/322 |
| 5,142,730 | A * | 9/1992 | Braks | A47L 7/0042 15/327.5 |
| 6,243,912 | B1 * | 6/2001 | Grey | A47L 7/0042 15/328 |
| 6,826,799 | B2 * | 12/2004 | Smith | A47L 5/18 15/409 |
| 7,299,522 | B1 * | 11/2007 | Smith | A47L 7/0038 15/409 |
| 8,153,001 | B2 * | 4/2012 | Peters | B01D 29/27 210/406 |
| 9,814,362 | B2 * | 11/2017 | Romero | A47L 5/365 |
| 9,863,441 | B2 * | 1/2018 | Eidmohammadi | A47L 7/0009 |
| 2003/0163890 | A1 * | 9/2003 | Smith | A47L 5/18 15/409 |
| 2006/0032014 | A1 * | 2/2006 | Smith | A47L 7/0042 15/409 |

(Continued)

*Primary Examiner* — Marc Carlson

(74) *Attorney, Agent, or Firm* — FULWIDER PATTON LLP

(57) ABSTRACT

An improved shop vacuum with wet/dry capability uses a vacuum tube that terminates in a space between the canister and the vacuum compartment such that the fluid and content exiting the vacuum tube is not directly opposed the negative pressure source. This allows the fluid to drain into the canister in a more controlled and less volatile condition, reducing splashing and entrainment of the fluid. Moreover, a second exit for the vacuum has been added to the canister to improve the efficiency of the vacuum and the overall performance of the device.

4 Claims, 5 Drawing Sheets

(56) References Cited

U.S. PATENT DOCUMENTS

| | | | | |
|---|---|---|---|---|
| 2015/0335217 | A1* | 11/2015 | Fritsche | A47L 5/24<br>134/10 |
| 2017/0280954 | A1* | 10/2017 | Romero | A47L 5/18 |
| 2020/0375422 | A1* | 12/2020 | Romero | A47L 7/0028 |

* cited by examiner

WET/DRY VACUUM DEVICE

CROSS-REFERENCES TO RELATED APPLICATIONS

This continuation application is based on U.S. Ser. No. 16/425,041, filed on May 29, 2019, the contents of which are fully incorporated by reference herein in its entirety.

BACKGROUND

U.S. Pat. No. 9,814,362, the contents of which are fully incorporated herein by reference, is directed to a wet/dry vacuum device that uses a negative pressure in a canister to pick up viscous and non-viscous fluids. The device of the '362 Patent is a hand held shop vacuum that includes a handle, a canister, a vacuum tube, and a pick-up device. The canister holds an enclosure that generates a negative pressure by forcing compressed, high velocity air through a orifice plug and out a muffler to create a vacuum in the enclosure. The vacuum in the enclosure is transferred to the vacuum tube and the pick-up device to pick up liquid or debris on a shop floor. The enclosure inside the canister includes a flow control valve such as a ball in cage device to prevent fluid from entering the enclosure. An evacuation spout is located at the bottom of the canister for draining the vacuum when the canister becomes full.

While the vacuum device of the '362 Patent has been commercially successful, it has been discovered that the exit to the vacuum tube inside the canister is proximal the vacuum source (canister 60), causing a violent turbulent flow at the exit of the vacuum tube that causes splashing and portions of the vacuumed liquid to be entrained into the rapidly moving airflow. This is undesirable and can lead to malfunction of the unit. Moreover, a single outlet to the canister has been determined to be inefficient in maximizing fluid extraction. The present invention is directed at improving the deficiencies and inefficiencies of the prior art.

SUMMARY OF THE INVENTION

The present invention is a shop vacuum with wet/dry capability that uses a vacuum tube that terminates in a space between the canister and the vacuum compartment such that the fluid and content exiting the vacuum tube is not directly opposed the negative pressure source. This allows the fluid to drain into the canister in a more controlled and less volatile condition, reducing splashing and entrainment of the fluid. Moreover, a second exit for the vacuum has been added to the canister to improve the efficiency of the vacuum and the overall performance of the device.

These and other benefits of the present invention will best be understood with reference to the drawings and the detailed description of the present invention below.

DETAILED DESCRIPTION OF THE PREFERRED EMBODIMENTS

Figure 1:
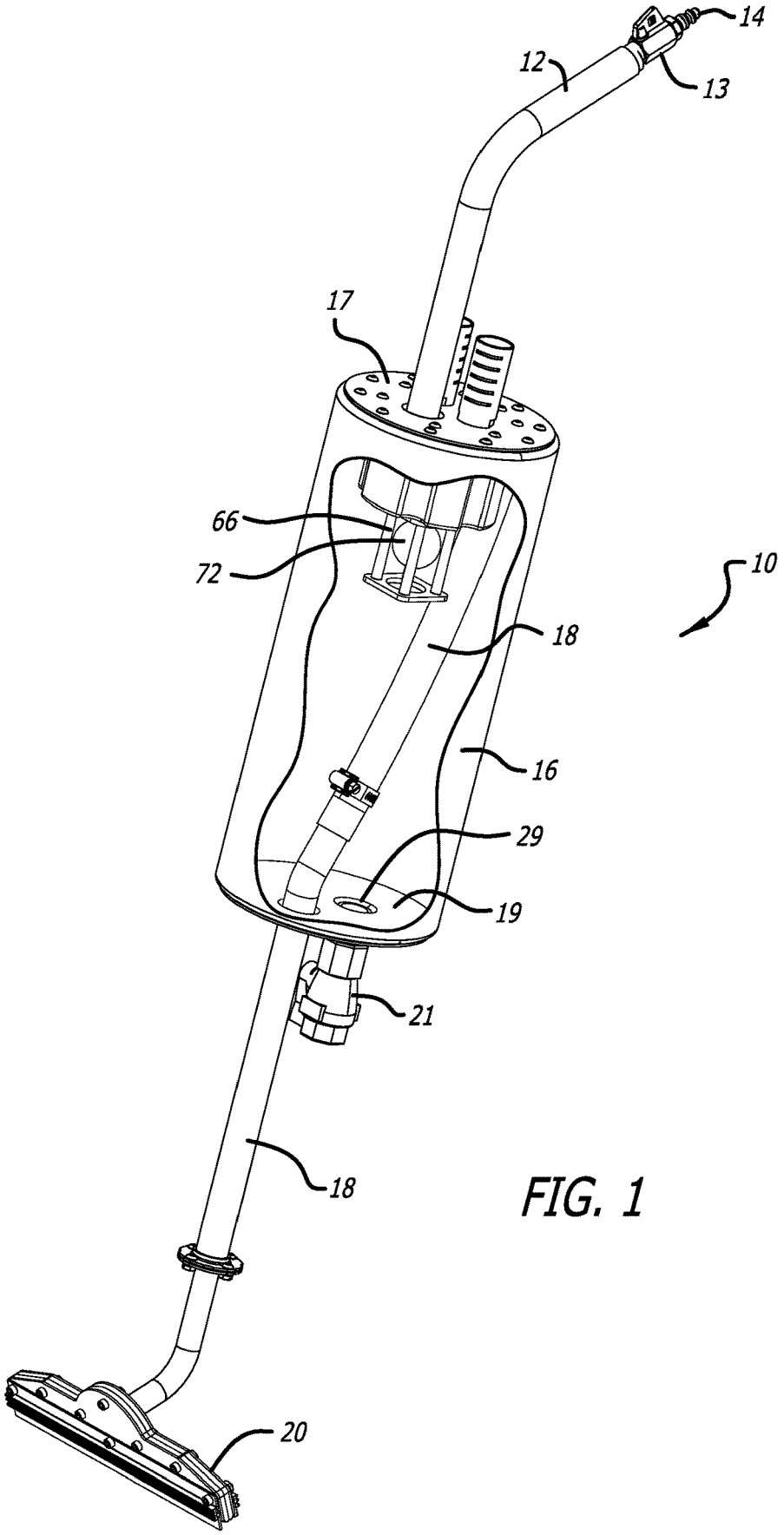
FIG. 1 is an elevated, perspective view, partially cut away, of a first embodiment of the present invention.

FIG. 1 illustrates a vacuum device, generally denoted 10, comprising a handle 12 that includes at a top end an air fitting 13 that includes a jack 14 adapted to couple to a positive pressure air flow source (not shown) that delivers air under pressure as is found in most automotive facilities. The handle 12 is connected to a polyethylene light weight canister 16 having a cylindrical peripheral wall enclosed by upper plate 17 and lower plate 19. At the lower end of the canister 16 protruding through the bottom plate 19 is a vacuum tube 18 that connects to a pick-up device 20, which may also include a gasket to prevent air leakage through this juncture. The canister 16 also includes a drain port 29 that can be used to drain the contents of the canister 16. When the canister 16 is to be drained, a knob 21 moves an occlusion to open the drainpipe 29 that allows fluid or debris to empty through the bottom of the canister.

Figure 4:
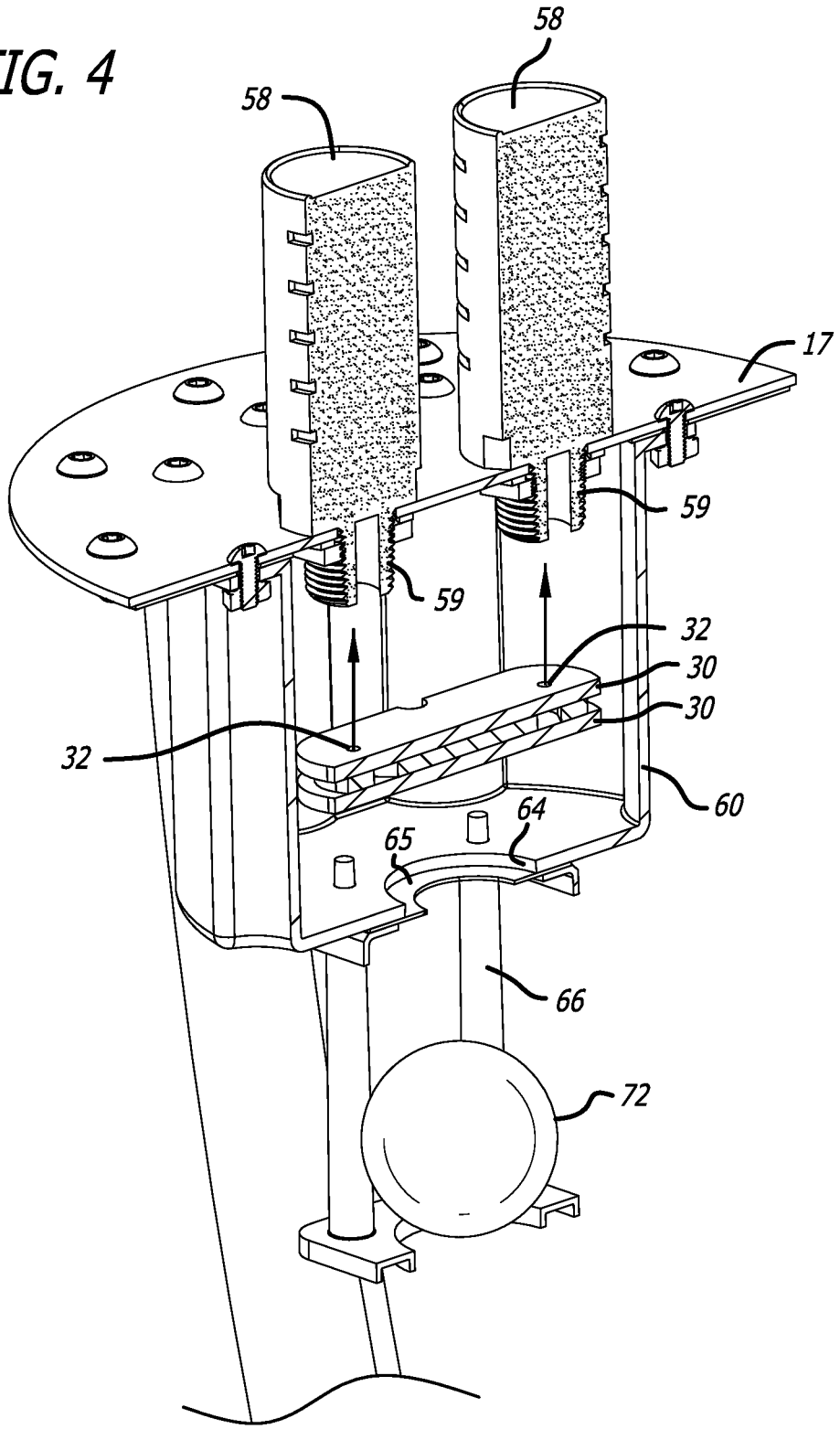
FIG. 4 is an enlarged, cross sectional view of the vacuum chamber.
Figure 5:
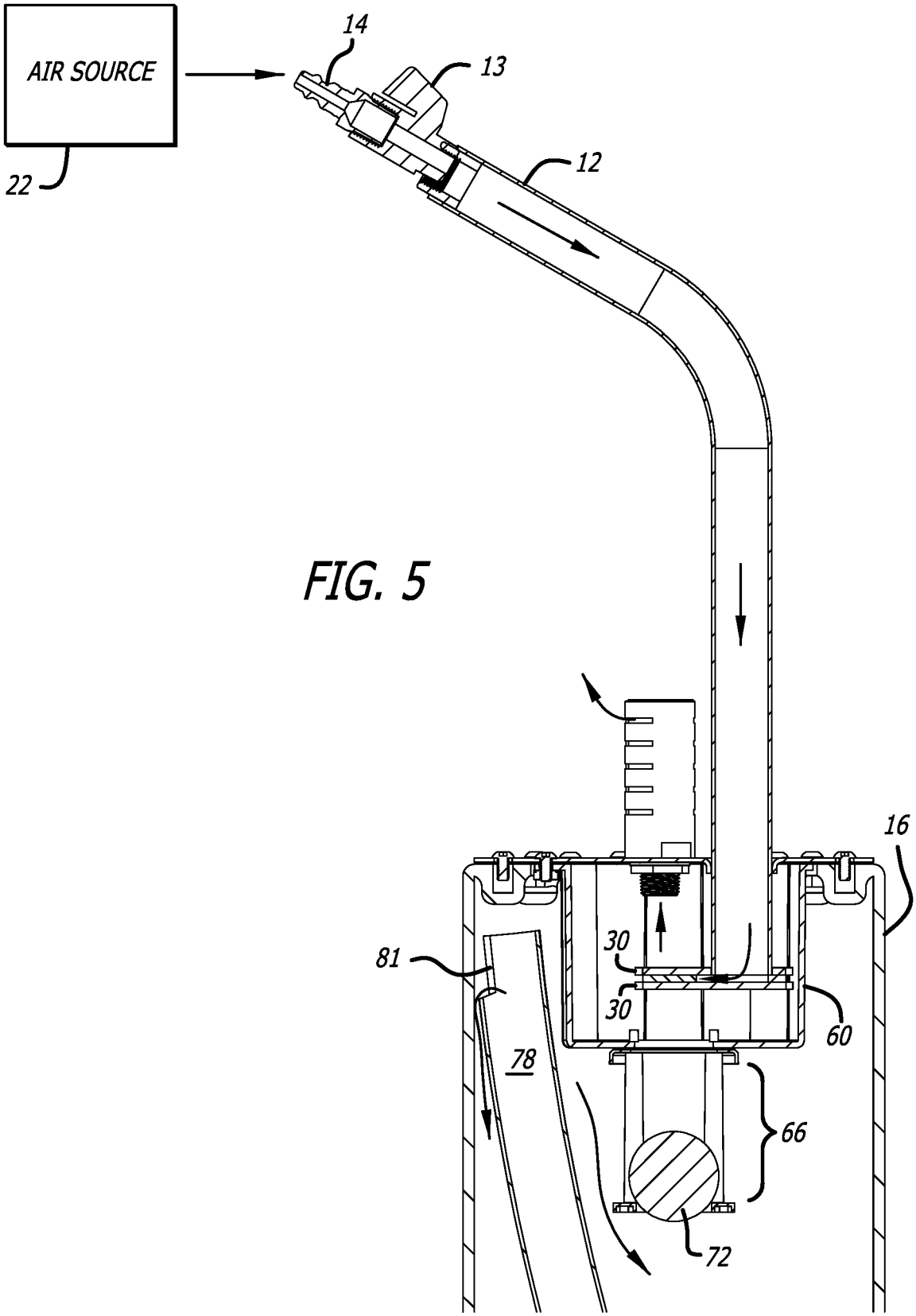
FIG. 5 is a cross sectional view showing the airflow through the vacuum chamber.

The handle 12 is a hollow elongate tube that passes through the upper plate 17 of the canister 16. With reference to FIG. 5, the air source 22 delivers pressurized air (indicated by arrows) that enter the handle through the jack 14 of fitting 13 and flows through the handle 12. The high pressure, high velocity air enters a pair of parallel plates having a divider 38 sandwiched between, that diverts the air to a pair of nozzles 32 (see FIG. 4) which can be openings in the upper plate. The accelerated airflow through the nozzles 32 is then passed out of the canister 16 through respective mufflers 58 positioned above the exit of the nozzles 32. The mufflers 58 and seals 63 suppress the sound and allow the air to exit the canister 16 and decelerate.

The passage of the high pressure air into and through the canister creates a low pressure region (via the "venturi effect") in the volume defined by compartment formed by enclosure 60 that is secured to the upper plate 17. For typical shop compressed air supplies, the pressure is approximately ninety (90) psi directed through the compartment 60. The enclosure 60 has an opening 64 at the bottom that is connected to a positive ball-in-cage shut-off device 66. When a fluid level in the canister 16 rises to a volume where it enters the shut-off device 66 and lifts the ball 72, the fluid lifts the ball 72 up until the vacuum in the enclosure 60 pulls the ball 72 against the seal 65 (FIG. 4) in the round opening 64, and isolates the exterior of the compartment 60 from the enclosure's interior and removes the pressure and shuts off the pressure imbalance between the two regions 16, 60.

In operation, the adapter 13 is connected at jack 14 to a supply of high pressure air (not shown). The high pressure air is forced through the handle 12 and into between the plates 30, and out the nozzles 32. The high pressure, high velocity air then enters respective orifice plugs 59 and through the mufflers 58. The passage of the high velocity air creates a low pressure condition in the compartment 60. This continuous low pressure condition is communicated to the portion of the canister 16 outside of the compartment 60. Vacuum tube 18, which has a first end 78 that is open to this region of the canister 16, communicates the low pressure condition to the pick-up device 20. Fluid, dust, debris, and other materials are sucked through the pick-up device and the vacuum tube 18, which it exits the vacuum tube and collects on the floor of the canister 16 in a collection area 100. When the canister is full, the air supply is disconnected and the drain port 29 is opened via knob 21 to allow the contents of the canister to flow through to a waste bin or the like. The knob 21 can then be returned to the closed position and further vacuuming can commence.

Figure 2:
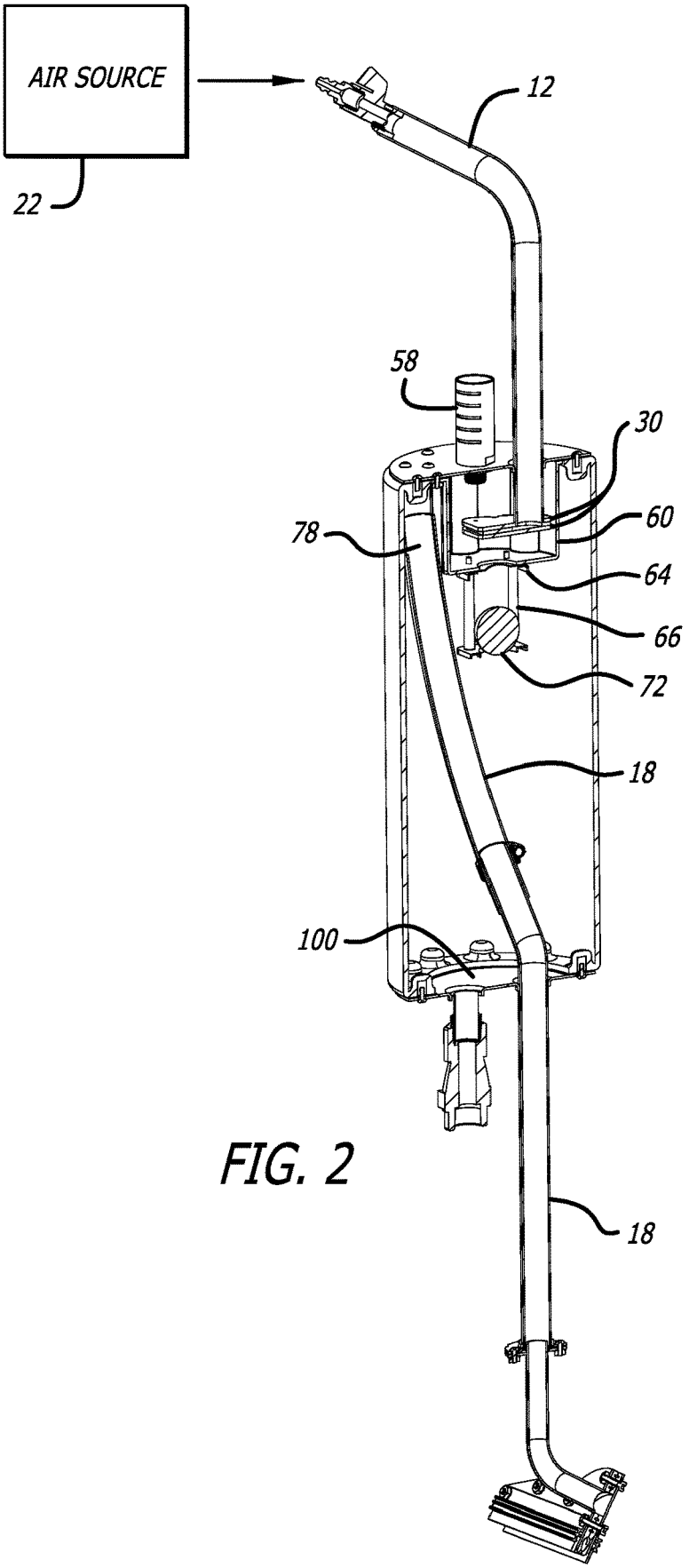
FIG. 2 is a cross sectional view of the embodiment of FIG. 1.
Figure 3:
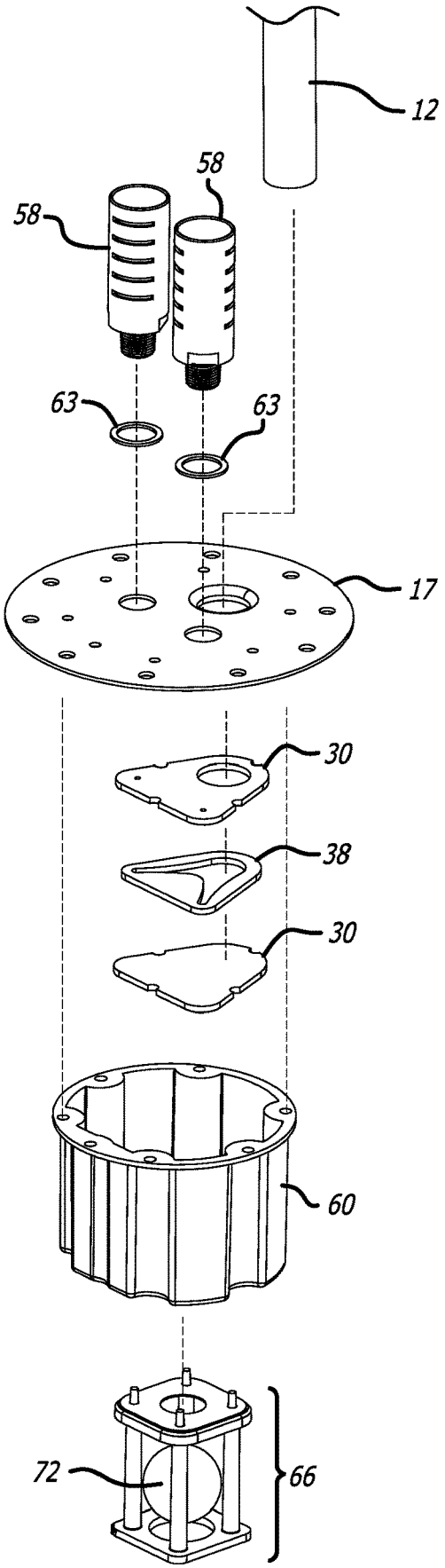
FIG. 3 is an exploded view of the vacuum compartment of the embodiment of FIG. 1.

As shown in FIG. 2, the upper end 78 of the vacuum tube 18 is disposed above the ball 72 of the shut-off device, above the compartment opening 64, and above the exit of the handle 12. This position allows the contents of the vacuum tube 18 to seep over the edge of the tube 18 and gradually fill the canister 16 without direct mixing with the airflow created by the vacuum adjacent the flow shut off device 66. The flow is not entrained into the air adjacent the vacuum source, and the effectiveness of the device is greatly improved. This effect is enhanced further by a notch 81 in the end 78 of the tube that is positioned away from the shut-off device 66, to shield the flow from the more turbulent flow adjacent the shut-off device 66. Thus, as shown in FIG. 5 the contents of the tube 18 flow over the notch 81 and down to the collection area 100 without entrainment into the shut-off valve 66.

The present invention shows two mufflers 58 above two nozzles 32 to improve the efficiency in which the air is removed from the compartment 60. A single muffler can lead to choking of the flow, but additional mufflers reduce the opportunity for choked flow and improve the operation of the vacuum.

The foregoing descriptions and illustrations are intended to be exemplary and not limiting. That is, one of ordinary skill in the art would readily appreciate that modifications and substitutions are available without departing from the scope and spirit of the invention, and that the present invention is intended to include all such modifications and substitutions. Accordingly, the proper construction of the scope of the invention is the words of the appended claims, using their plain and ordinary meaning, in view of but not limited by the preceding descriptions and the illustrations included herewith.

I claim:

1. A vacuum connectable to a supply of compressed air, comprising:

a canister connectable to the supply of compressed air and comprising an air outlet;

a handle mounted to the canister;

a vacuum tube having an open first end inside the canister and an open second end outside the canister;

a nozzle inside the canister and coupled to the supply of compressed air, the nozzle configured to direct a portion of the compressed air through the air outlet of the canister;

a flow control device inside the canister, the flow control device positioned below the open first end of the vacuum tube; and a closable drain-pipe forming a material outlet to the canister.

2. The vacuum of claim 1, further comprising a notch in the first end of the vacuum tube to direct a flow therein through.

3. The vacuum of claim 2, wherein the notch is positioned opposite the flow control device.

4. The vacuum of claim 1, wherein the nozzle comprises:

a pair of spaced apart parallel plates and a flow divider disposed between the parallel plates; and an opening in an upper one of the pair of spaced apart parallel plates.

* * * * *